United States Patent [19]

Elliott

[11] Patent Number: 4,574,507

[45] **Date of Patent: * Mar. 11, 1986**

[54] STREET SIGN ADAPTOR UNIT AND ASSEMBLY INCLUDING THE SAME

[76] Inventor: Paul G. Elliott, 117 Railroad Ave., Donaldsonville, La. 70346

[ * ] Notice: The portion of the term of this patent subsequent to Jan. 17, 2001 has been disclaimed.

[21] Appl. No.: 569,797

[22] Filed: Jan. 10, 1984

Related U.S. Application Data

[63] Continuation-in-part of Ser. No. 330,962, Dec. 15, 1981, Pat. No. 4,425,728.

[51] Int. Cl.[4] ..... G09F 15/00

[52] U.S. Cl. ..... 40/607; 40/10 C; 52/103

[58] Field of Search ..... 40/607, 606, 10; 116/209; 52/103

[56] References Cited

U.S. PATENT DOCUMENTS

| | | | |
|---|---|---|---|
| 716,098 | 12/1902 | Plumbly | 40/607 |
| 965,566 | 7/1910 | Cooley | 40/607 |
| 1,220,716 | 3/1917 | Beery | 40/607 |
| 1,890,483 | 12/1932 | Wood et al. | 40/607 |
| 2,950,787 | 8/1960 | Walsh | 40/607 |
| 3,138,886 | 6/1964 | Cobb | 40/607 |
| 3,250,032 | 5/1966 | Von Gal | 40/607 |
| 4,425,728 | 1/1984 | Elliot | 40/607 |

*Primary Examiner*—Gene Mancene
*Assistant Examiner*—Wenceslao J. Contreras
*Attorney, Agent, or Firm*—James M. Pelton

[57] ABSTRACT

A street sign adaptor unit and a street sign assembly for allowing use of standard V-notch perforate or cylindrical metal fence or highway sign posts to be used with standard sign panels for intersecting streets in which the adaptor unit has a varied cross-section to accommodate attachment and fixation with standard fasteners and without expensive conversion apparatus to both types of post and to sign panels.

3 Claims, 6 Drawing Figures

STREET SIGN ADAPTOR UNIT AND ASSEMBLY INCLUDING THE SAME

CROSS REFERENCE TO RELATED APPLICATIONS

This application is a continuation-in-part of my copending application Ser. No. 330,962, filed Dec. 15, 1981, now allowed and to be issued as U.S. Pat. No. 4,425,728 on Jan. 17, 1984.

BACKGROUND OF THE INVENTION

This invention relates to a street sign adaptor unit and its use in a street sign assembly which is less expensive and more easily installed than street signs using tubular steel posts and the associated hardware used to fix the street sign to the tubular post.

Street signs are well known and in common use with a variety of designs and attachment hardware. For example, Plumbly U.S. Ser. No. 716,098 teaches a street sign assembly in which two pairs of right angularly disposed sign panels are set in back-to-back relation about the tubular adaptor and have upper, lower and intermediate coupling members holding the pairs of sign panels in fixed relation. The machined or stamped parts, threaded connections and tubular post are items which contribute to the cost of this assembly. Further, Ridenour U.S. Pat. No. 1,139,802 shows an additional method of attachment of sign panels to support posts. Finally, Von Gal, Jr., et al. U.S. Pat. No. 3,250,032 teaches the use of conventional fence and highway sign posts of rolled, extruded or pressed steel, iron or aluminum material having projecting, parallel, coplanar side flanges between which a body of trapezoidal cross-section including side walls which converge into a perforate rear wall which is in parallel relation to the side flanges for anchoring and supporting a rotatably adjustable sign in which the rotation mechanism is attached to the upper and lower post sections by trapezoidally cross-sectioned shank and stud portions. However, such conventional fence or sign posts are not adapted to display signs for intersecting streets, e.g., those having sign panels at approximately right angles to each other.

Of further interest is Cooley, U.S. Ser. No. 965,566 which teaches a sign permitting different sign panels to be attached at various angles by means of a post having a slotted head with brackets supporting sign panels attached thereto by fasteners, such as nuts and bolts. Wood, U.S. Pat. No. 1,890,483, teaches a sign having two panels centrally attached on either side to a post and having their ends fastened together. Other patents teaching similar methods of attachment or similar post construction or different adaptation are Beery U.S. Pat. No. 1,220,716; Walsh, U.S. Pat. No. 2,950,787; and Cobb, U.S. Pat. No. 3,138,886.

SUMMARY OF THE INVENTION

According to the present invention, there is provided a street sign adaptor unit for use in the placement of street signs on a perforate metal post of trapezoidal cross-section comprising a lower portion having a trapezoidal cross-section for fitment with the post, the lower portion having means in register with the perforations of the post whereby the unit is attachable to the post and an upper portion having means for attachment of at least one sign panel thereto.

Another embodiment of this invention provides a street sign assembly comprising, in combination, a post having projecting, parallel coplanar side flanges between which there is provided a body of trapezoidal cross-section including side walls converging into a perforate rear wall, said rear wall being in parallel relation to said side flanges; an adaptor unit having a lower portion of a cross-section designed for fitment between the converging side walls of said post and apertures in register with the perforations of said rear wall of said post and an upper portion of a length sufficient for attachment thereto of at least one sign panel; at least one sign panel; and means for securely fastening said adaptor unit and said at least one sign panel to said post.

Another aspect of this invention provides a street sign adaptor unit for use in placement of street signs identifying intersecting streets and adaptable to both perforate metal posts of trapezoidal cross-section and cylindrical hollow metal posts, said adaptor unit comprising a lower portion having a trapezoidal cross-section for fitment within the trapezoidal cross-section of said perforate metal posts or within the top portion of said cylindrical hollow metal posts, said lower portion having means in register with the perforations of said trapezoidal cross-section perforate metal post whereby said unit is attachable to said trapezoidal cross-section perforate post and an upper portion of approximately square cross-section and being greater in area than said lower portion so that at the juncture of the said upper portion and said lower portion said upper portion extends over the largest parallel side of the trapezoidal cross-section of the lower portion forming a shoulder suitable for retaining a wedge used in fixing said adaptor unit in said cylindrical metal post.

DESCRIPTION OF THE DRAWINGS

The present invention is further illustrated in the figures of the drawings in which.

DETAILED DESCRIPTION OF PREFERRED EMBODIMENTS

The street sign assembly of the present invention is a unique adaptation of presently available materials and a response to the needs of municipalities and local governments to provide existing services at lower cost to the public. Street signs must meet rigorous operational criteria of low cost and maintenance, easy installation, resistance to weather and vandalism and high service life and readability. Strangely enough, these factors can all be met even though at first glance they seem highly incompatible. For example, in making a street sign vandal-resistant, one would first think of rugged, expensive metal materials and difficult to remove hardware. However, in contrast, the use of easily replaceable, cheap materials which are easily attached and removed markedly decreases the "challenge" and "trophy value" of a street sign and, hence, decreases the "thrill" of its acquisition or destruction. The present adaptor unit allows the use of standard V-notch, holed, fence posts or high sign posts which are not readily convertible to use at intersecting streets because of their design for one-way attachment. Additionally, such V-notch, holed posts are less expensive and more readily available than tubular iron or steel posts. Further, installation costs are far less than required by the conventional tubular posts. It is therefore surprising that they have not heretofore been employed with the adaptor units of the present novel design or of other designs in street sign applications at intersecting streets.

Figure 1:
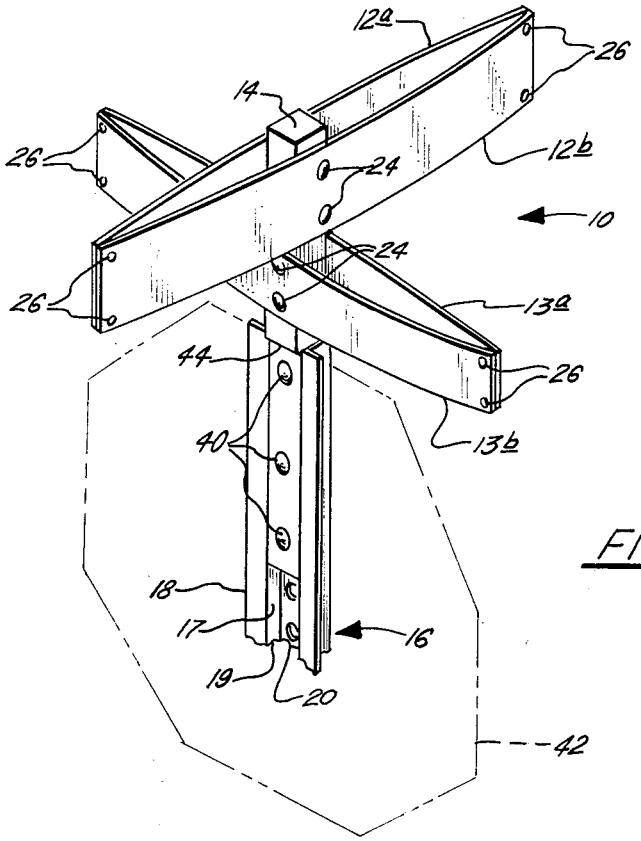
FIG. 1 is a perspective view of the street sign assembly of this invention used with a perforate metal post.
Figure 2:
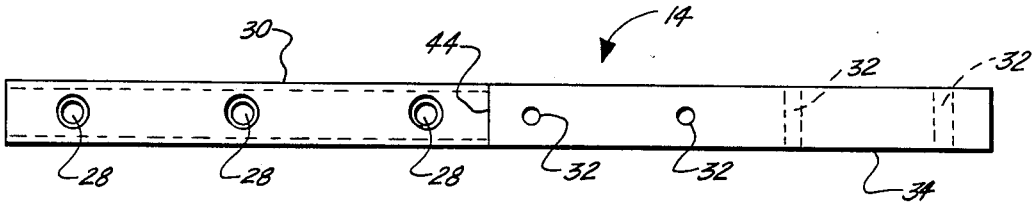
FIGS. 2 and 3 are top and elevational views of the adaptor unit employed in the street sign assembly of FIG. 1.
Figure 3:
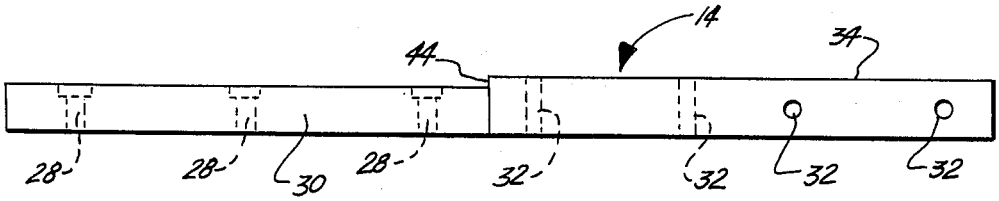
Figure 5:
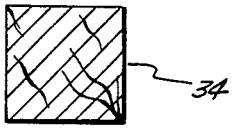
FIGS. 5 and 6 are cross sections of the adaptor unit taken along section lines 5—5 and 6—6, respectively of FIG. 4.
Figure 6:
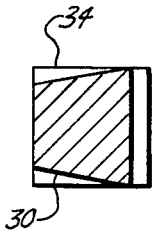

Referring to FIG. 1, the street sign assembly of this invention is generally indicated by the numeral 10 and includes a first pair of sign panels 12*a* and 12*b* and a second pair of sign panels 13*a* and 13*b* disposed in back-to-back relation about an adaptor unit 14 with the first pair of sign panels 12*a* and 12*b* being attached to the adaptor unit 14 at approximately right angles to the second pair of sign panels 13*a* and 13*b* by attaching bolts 24. As shown in FIGS. 2 and 3, adaptor unit 14 has an upper portion 34 which is of square cross-section and a lower portion 30 which is of trapezoidal cross-section (see FIGS. 5 and 6) for better fit into support post 16 (see FIG. 1). Bolt holes 28 and 32 are provided to accommodate attachment of sign panels 12*a*, 12*b*, 13*a* and 13*b* to the upper portion 34 of adaptor unit 14 and the lower portion 30 of adaptor unit 14 to support post 16.

The support post is of standard, rolled, pressed or extruded metal such as iron, steel or aluminum, as is conventional, and includes side flanges 18 attached to a trapezoidal body 19 with side walls 17 converging to perforate rear wall 20 which is in parallel relation with side flanges 18. The rear wall 20 carries numerous vertically aligned perforations 22.

The sign panels 12*a*, 12*b*, 13*a* and 13*b* illustrated in FIG. 1 are identical, but need not be. A more detailed illustration of a preferred sign panel 12*a* as shown in FIG. 1 as having a thin rectangular shape with appropriate fasteners 24 for attachment to the upper section 34 of adaptor unit 14 and fasteners 26 for holding the ends of sign panels 12*a* and 12*b* or 13*a* and 13*b* together.

The adaptor unit 14 and sign panels 12*a*, 12*b*, 13*a* and 13*b* can be constructed of metal, wood or plastic materials which are inexpensive, weather-resistant and easily formed. Preferably, the adaptor unit 14 is of wood and the sign panels are of plastic.

As thus far described hereinabove, the adaptor unit 14 is similar to the street sign adaptor unit of my copending application Ser. No. 330,962, filed Dec. 15, 1981. However, higher sign posts are now being used, for example, which are ten (10) feet in height, and which carry traffic control signs as well as street identification signs. Such are illustrated in FIG. 1 which also shows a stop sign 42 (in phantom). In order to have the stop sign 42 firmly attached, the face of lower portion 30 must be not higher than coplanar with the flanges 18 of post 16. This allows flush fitment of the stop sign 42 or other traffic control sign and one or more of the lower bolt holes 28 can be used with bolts 40 and nuts (not shown) to fix the stop sign 42 in place. The shoulder 44 of upper portion 34 of adaptor unit 14 extends out over the stop sign 42. Ordinarily this shoulder would not be necessary and the adaptor unit could be manufactured with a reduced cross-section of upper portion 34. However, by providing the adaptor unit 14 with this unique configuration it is also easily converted to use in standard cylindrical hollow metal posts many of which are already in place.

This added, unique feature of the present invention provides a structure which differs from those known in the prior art and which allows use on both the V-notched perforated metal posts and the hollow cylindrical metal posts. So far as it is known no other street sign adaptor unit can be employed in both uses with metal posts of such different shapes.

Figure 4:
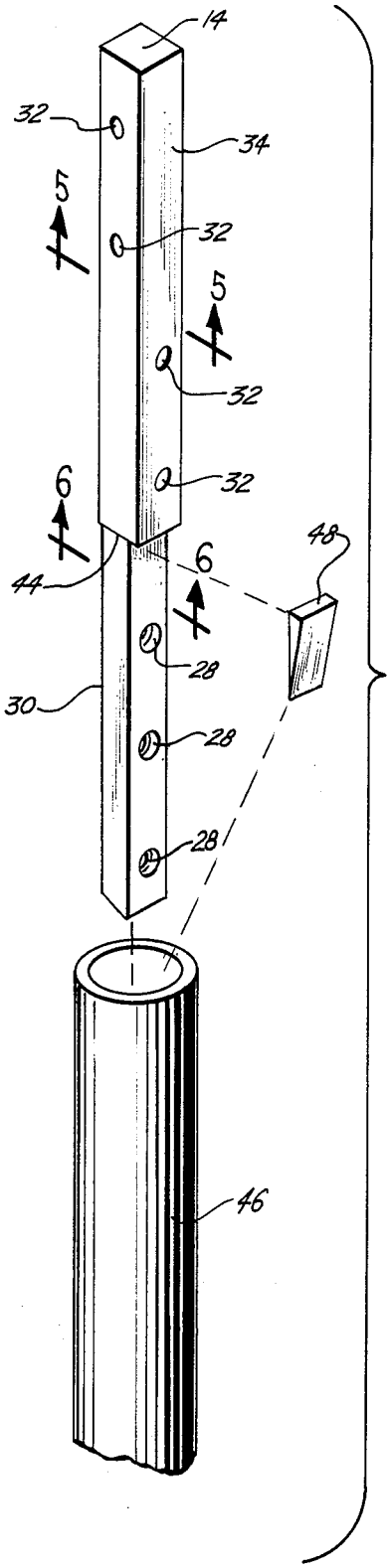
FIG. 4 is an exploded view of the street sign adaptor unit of this invention used with a cylindrical post.

As illustrated in FIG. 4 the lower portion 30 of adaptor unit 14 is lowered into the top of hollow metal cylindrical post 46. As this is being done, wedge 48 is placed in interference fit with the front face of lower portion 30 and the inside of the hollow metal cylindrical post 46. The adaptor unit 14 is then hammered home so that shoulder 44 fits over wedge 48, preventing removal of the wedge 48, and just above the top of the post 46. In this position it is firmly wedged into the metal post 46 and the wedge cannot be dislodged for removal of the adaptor unit 14. Then sign panels can be attached in the manner previously described. Through this simple yet unique structural change in the adaptor unit of the present invention the utility of the street sign assembly is widely increased.

Having described the various embodiments of this invention illustratively, those skilled in the art will readily envision various changes and modifications which can be made within the scope and spirit of this invention. Therefore, it is desired that the present invention be limited only by the lawful scope of the following claims.

What is claimed is:

1. A street sign adaptor unit for use in placement of street signs identifying intersecting streets and adaptable to both perforate metal posts of trapezoidal cross-section and cylindrical hollow metal posts, said adaptor unit comprising a lower portion having a trapezoidal cross-section for fitment within the trapezoidal cross-section of said perforate metal posts or within the top portion of said cylindrical hollow metal posts, said lower portion having means in register with the perforations of said trapezoidal cross-section perforate metal post whereby said unit is attachable to said trapezoidal cross-section perforate post and an upper portion of approximately square cross-section and being greater in area than said lower portion so that at the juncture of the said upper portion and said lower portion said upper portion extends over the largest parallel side of the trapezoidal cross-section of the lower portion forming a shoulder suitable for retaining a wedge used in fixing said adaptor unit in said cylindrical metal post.

2. The adaptor unit of claim 1 in which said upper portion has means for attachment of at least two sign panels at approximately right angles to each other.

3. The adaptor unit of claims 1 and 2 in which the attachment means of said upper and lower portions of said unit are further characterized as being bolt holes extending through said unit in a direction normal to the central axis through said unit.

* * * * *